United States Patent [19]

Namnath

[11] Patent Number: 4,601,845

[45] **Date of Patent: * Jul. 22, 1986**

[54] BLEACHING COMPOSITIONS CONTAINING MIXED METAL CATIONS ADSORBED ONTO ALUMINOSILICATE SUPPORT MATERIALS

[75] Inventor: James S. Namnath, Demarest, N.J.

[73] Assignee: Lever Brothers Company, New York, N.Y.

[ * ] Notice: The portion of the term of this patent subsequent to Aug. 20, 2002 has been disclaimed.

[21] Appl. No.: 719,095

[22] Filed: Apr. 2, 1985

[51] Int. Cl.[4] ..... C11D 3/06; C11D 3/39; D06L 3/02

[52] U.S. Cl. ..... 252/99; 252/95; 252/186.38; 252/174.25; 252/174.12; 8/107

[58] Field of Search ..... 252/94, 95, 99, 186.38, 252/174.25; 8/107

[56] References Cited

U.S. PATENT DOCUMENTS

| | | | |
|---|---|---|---|
| 2,820,690 | 7/1954 | Feldmann | 8/111 |
| 3,156,654 | 11/1965 | Konecny et al. | 252/95 |
| 3,325,397 | 6/1967 | Plank et al. | 208/120 |
| 3,398,096 | 8/1968 | Das et al. | 252/95 |
| 3,488,288 | 1/1970 | Hill | 252/99 |
| 3,532,634 | 10/1970 | Woods | 252/95 |
| 4,207,199 | 6/1980 | Perner et al. | 252/174.13 |
| 4,208,295 | 6/1980 | Sai et al. | 252/94 |
| 4,247,731 | 1/1981 | Wunder et al. | 585/640 |
| 4,307,010 | 12/1981 | Sandler et al. | 260/42.47 |
| 4,430,243 | 2/1984 | Bragg | 252/91 |
| 4,478,733 | 10/1984 | Oakes | 252/99 |
| 4,481,129 | 11/1984 | Oakes | 252/186.41 |
| 4,488,980 | 12/1984 | Oakes | 252/99 |
| 4,536,183 | 8/1985 | Namnath | 8/107 |

FOREIGN PATENT DOCUMENTS

| | | |
|---|---|---|
| 25608 | 3/1981 | European Pat. Off. . |
| 70079 | 7/1982 | European Pat. Off. . |
| 72166 | 2/1983 | European Pat. Off. . |
| 82563 | 6/1983 | European Pat. Off. . |

OTHER PUBLICATIONS

"Transition Metal Ions on Molecular Sieves. II. Catalytic Activities of Transition Metal Ions on Molecular Sieves For the Decomposition of Hydrogen Peroxide", by Mochida et al., J. Phys. Chem., 78, pp. 1653–1657 (1974).

*Primary Examiner*—Prince E. Willis
*Attorney, Agent, or Firm*—Milton L. Honig; James J. Farrell

[57] ABSTRACT

A bleaching composition is provided comprising a peroxy compound and a peroxide catalyst. The catalyst is an aluminosilicate, perferably a zeolite, whereon is adsorbed a water-soluble manganese (II) salt and magnesium or zinc divalent cations.

21 Claims, No Drawings

BLEACHING COMPOSITIONS CONTAINING MIXED METAL CATIONS ADSORBED ONTO ALUMINOSILICATE SUPPORT MATERIALS

BACKGROUND OF THE INVENTION

1. Field of the Invention

The invention relates to a bleach catalyst, processes for its preparation and bleaching compositions incorporating this catalyst.

2. The Prior Art

Dry bleaching powders, such as those for cleaning laundry, generally contain inorganic persalts as the active component. These persalts serve as a source of hydrogen peroxide.

Normally, persalt bleach activity in aqueous solution is undetectable where temperatures are less than 100° F. and delivery dosages less than 100 ppm active oxygen. The art has recognized, however, that bleaching under mild conditions may be effectuated through the use of activators.

U.S. Pat. No. 3,156,654 discloses heavy metal ions such as cobalt in combination with chelating agents to catalyze peroxide decomposition. U.S. Pat. No. 3,532,634 suggests a similar approach but with cations that are transition metals having atomic number 24 to 29. Neither system is totally satisfactory.

Bare metal ions, even when chelated, accelerate wasteful decomposition reactions that are non-bleach effective. Under alkaline conditions, as with laundry cleaning compositions, metal ions undergo irreversible oxidation. Perversely, the peroxide bleaching reaction is most effective at high pH. Furthermore, the prior art metal ion catalysts are sensitive to water hardness. Their activity varies with the calcium and magnesium content of the water source.

Manganese (II) salts have been reported to be exceptionally effective in activating persalts under mild conditions. European patent application No. 0 082 563 discloses bleach compositions containing manganese (II) in conjunction with carbonate compounds. British patent application No. 82 36,005 describes manganese (II) in conjunction with a condensed phosphate/orthophosphate and an aluminosilicate, the builder combination enhancing bleach performance.

The aforementioned compositions stil suffer from the presence of soluble manganese (II) ions. When utilized for whitening laundry, the soluble ions deposit on fabrics. Strong oxidants, such as hypochlorites, are frequently included in laundry washes. Deposited manganese will react with strong oxidants to form highly staining manganese dioxide.

European patent application No. 0 025 608 reveals to peroxide decomposition catalyst consisting of zeolites or silicates whose cations have been exchanged for heavy metals such as manganese. Co-pending U.S. application Ser. No. 597,971, now U.S. Pat. No. 4,536,183 discloses a bleach activator comprising a water-soluble manganese (II) salt adsorbed onto a solid inorganic silicon support material, the combination having been prepared at a pH from 7.0 to 11.1. Although these systems provide adequate bleaching, more potent catalysts would be desirable where the amount of catalyst must be kept at a low level. Economics, peroxide stability, compatibility and environmental considerations encourage use of activator systems with the highest possibe activity.

U.S. Pat. No. 4,208,295 (Sai et al.) discloses bleaching detergent compositions wherein water-insoluble aluminosilicates have had their cations partially exchanged with calcium or magnesium ions. Incorporation of calcium and magnesium was found to improve the storage stability of sodium percarbonate. Evidently, these particular divalent cations were not considered as bleach accelerators but, rather, as stabilizers to prevent decomposition of peroxide.

Consequently, it is an object of the present invention to provide a bleaching composition containing a persalt and a manganese bleach catalyst that will not result in substrate staining.

A further object of this invention is to provide a nonstaining bleach composition exhibiting exceptionally high bleach performance.

Another object of this invention is to provide a process for the preparation of manganese bleach catalysts.

SUMMARY OF THE INVENTION

A bleaching composition is provided comprising a peroxy compound and a peroxide catalyst comprising an aluminosilicate support material whereon is adsorbed a water-soluble manganese (II) salt and a salt of a divalent metal cation selected from magnesium or zinc, the weight ratio of manganese (II) to divalent metal cation being from about 1:20 to 20:1, the ratio of divalent metal cation to aluminosilicate support material ranging from about 1:1000 to 1:10, and the weight ratio of catalyst to peroxy compound being from about 1:100 to 1:1.

Furthermore, a process for the preparation of a catalyst for the controlled decomposition of peroxy compounds is disclosed comprising:

(a) dissolving a water-soluble salt of manganese (II) and of a divalent metal cation selected from magnesium or zinc, in a solvent and therein suspending an aluminosilicate support material to form a slurry, the weight ratio of divalent metal cation to the aluminosilicate ranging from 1:1000 to 1:10 and of manganese (II) to divalent metal cation ranging from about 1:20 to 20:1;

(b) adjusting pH to achieve a value from about 7.0 to 11.1;

(c) agitating the slurry mixture of divalent metal salt and a luminosilicate support material;

(d) separating solids from the slurry and washing said solid composition with solvent to remove any traces of free manganese (II) salts; and (e) drying the solid composition to remove solvent and moisture.

DETAILED DESCRIPTION OF THE INVENTION

It has been found that a highly effective bleaching catalyst is obtained by treatment of an aluminosilicate support material with a divalent magnesium or zinc salt in conjunction with a manganese (II) salt. This mixed metal impregnated aluminosilicate catalyst is an impovement over the aluminosilicate containing only adsorbed manganese (II) cations which is reported in copending U.S. application Ser. No. 597,971, herein incorporated by reference. Moreover, the mixed metal catalyst still maintains all the desirable features of the single metal impregnated catalyst. For instance, the problem of staining is still avoided. The problem arises when fabrics are laundered in the presence of free manganese cations. Some of these cations deposit onto the fabric. Subsequent laundering in the presence of strong oxidants, e.g. sodium hypochlorite, converts the deposited cations into colored manganese dioxide. Stains are thereby formed.

Cations such as iron, copper and calcium when used as replacements for mangesium or zinc no activity improvement over non-treated aluminosilicate support material having manganese (II) adsorbed thereon.

The manganese used in the present invention can be derived from any manganese (II) salt which delivers manganous ions in aqueous solution. Manganous sulfate and manganous chloride or complexes thereof, such as manganous triacetate, are examples of suitable salts.

The aluminosilicate support material is preferably of a pore size of from 3 to 10 Angstroms, more preferably from 3 to 5 Angstroms.

Zeolites, in powder form, are the preferred support materials, especially where the composition is intended for laundering clothes. Amorphous aluminosilicates are, however, also suitable as support materials. Many commercial zeolites have been specifically designed for use in laundering applications. Accordingly, they exhibit the favorable properties of dispersivity in wash solution. Moreover, their tendency for being entrapped by fabrics is low. Synthetic zeolites are preferred over the natural ones. The latter have an appreciable content of extraneous metal ions that may promote wasteful peroxide decomposition reactions. Illustrative of commercially available zeolites falling within the scope of this invention are the 4A and 13X type sold by Union Carbide under the designation ZB-100 and ZB-400, respectively. ZB-100 has an average pore size of 4 Angstroms. ZB-400 has an average pore size of 10 Angstroms.

Another type of suitable support material is the silicoalumino phosphates (SAPOs). These materials are also commercially available from Union Carbide. SAPOs have a wide range of compositions within the general formula $0\text{–}0.3R(Si_xAl_yP_z)O_2$ where x, y and z represent the mole fractions of Si, Al and P, respectively. The range for x is 0.01 to 0.98, for y from 0.01 to 0.60, and for z from 0.01 to 0.52. R refers to the organic template that is used to develop the structure of the particular SAPO. Typical templates used in preparing SAPOs are organic amines or quaternary ammonium compounds. Included within the SAPO family are structural types such as $AlPO_4$-16, Sodalite, Erionite, Chabazite, $AlPO_4$-11, Novel, $AlPO_4$-5 and Faujasite.

Finished catalyst will contain from about 0.1% to about 5.5% (II) per weight of solid support. Preferably, the amount of manganese (II) is from about 1 to about 2.5%.

The catalyst and compositions of this invention may be applied to hard substrates such as dentures, bathroom tiles, toilet bowls and ceramic floors. Flexible substrates, specifically laundry, will, however, be focused upon in the subsequent discussion.

Laundry bleach compositions of this invention comprise, besides the mixed metal catalyst, a peroxide source and a phosphate stabilizer. Suitable peroxy compounds include the inorganic persalts which liberate hydrogen peroxide in aqueous solution. These may be water-soluble perborates, percarbonates, perphosphates, persilicates, persulfates and organic peroxides. Amounts of peroxy compound in the dry bleach powder should range from about 5 to about 30%. At least 30 ppm active oxygen should be delivered by the persalt to a liter of wash water. For instance, with sodium perborate monohydrate, this represents a minimum amount of 200 mg per liter of wash water.

The catalyst should deliver a minimum level of 0.5 ppm manganese (II) ion to the wash. For instance, if a catalyst has 1 weight % of manganese then at least 5 grams catalyst per liter of wash solution is required.

The ratio of active oxygen generated by peroxy compound to manganese (II) ion in aqueous solution ranges from about 1000:1 to 1:1000, preferably 1000:1 to 1:10.

Phosphate stabilizers are suggested for combination with the dry bleach powders. Suitable stabilizers include the alkali metal salts of tripolyphosphate, orthophosphate and pyrophosphate. Amounts of phosphate stabilizer should range from about 5% to about 35%. Preferably, they should be present from about 10% to 15%. In aqueous solution, the phosphate stabilizer level should be at least 10 ppm, the ratio of stabilizer to peroxy compound being from about 10:1 to 1:10.

Surface active detergents may be present in an amount from about 2% to 50% by weight, preferably from 5% to 30% by weight. These surface active agents may be anionic, nonionic, zwitterionic, amphoteric, cationic or mixtures thereof.

Among the anionic surfactants are water-soluble salt of alkylbenzene sulfonates, alkyl sulfates, alkyl ether sulfates, paraffin sulfonates, α-olefin sulfonates, α-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and β-alkoxyalkane sulfonates. Soaps are also preferred anionic surfactants.

Nonionic surfactants are water-soluble compounds produced by the condensation of ethylene oxide with a hydrophobic compound such as alcohol, alkyl phenol, polypropoxy glycol or polypropoxy ethylene diamine.

Cationic surface active agents include the quaternary ammonium compounds having 1 to 2 hydrophobic groups with 8–20 carbon atom, e.g., cetyl trimethylammonium bromide or chloride, and dioctadecyl dimethylammonium chloride.

A further exposition of suitable surfactants for the present invention appears in "Surface Active Agents and Detergents", by Schwartz, Perry & Berch (Interscience, 1958), the disclosure of which is incorporated herein by reference.

Detergent builders may be combined with the bleach compositions. Useful builders can include any of the conventional inorganic and organic water-soluble builder salts. Typical of the well known inorganic builders are the sodium and potassium salts of the following: pyrophosphate, tripolyphosphate, orthophosphate, carbonate, bicarbonate, silicate, sesquicarbonate, borate and aluminosilicate. Among the organic detergent builders that can be used in the present invention are the sodium and potassium salts of citric acid and nitrilotriacetic acid. These builders can be used in an amount from 0 up to about 80% by weight of the composition, preferably from 10% to 50% by weight.

Apart from detergent active compounds and builders, compositions of the present invention can contain all manner of minor additives commonly found in laundering or cleaning compositions in amounts in which such additives are normally employed. Examples of these additives include: lather boosters, such as alkanolamides, particularly the monoethanolamides derived from palm kernel fatty acids and coconut fatty acids; lather depressants, such as alkyl phosphates, waxes and silicones; fabric softening agents; fillers; and usually present in very minor amounts, fabric whitening agents, perfumes, enzymes, germicides and colorants.

The following examples will more fully illustrate the embodiments of the invention. All parts, percentages and proportions referred to herein and in the appended claims are by weight unless otherwise indicated.

EXAMPLE 1

A vessel was charged with 125 grams zeolite (ex. Union Carbide ZB-100) and approximately 100 ml deionized water. The pH of this slurry was lowered to 9.5 with 1N hydrochloride acid. Hydrated magnesium chloride, 20.3 grams, was dissolved in water and added to the zeolite slurry. For about 20 minutes the zeolite slurry was stirred with the magnesium salt. Approximately 0.8 millequivalent hydrated magnesium chloride was employed per gram of zeolite support.

Subsequent to this treatment, 5 grams manganese chloride was added to the slurry and the mixture agitated for an additional 20 minutes. Solids were then filtered and washed with sufficient water to remove any unadsorbed manganese. The catalyst was then dried.

Several methods of drying the catalyst may be employed. In one method, the catalyst is contacted with a volatile water miscible organic solvent (bp<60° C.) below the solvent's boiling point to remove moisture through dissolution. Acetone or methanol are suitable solvents. A more economical drying process utilizes heat. Normally, temperatures below 130° C. are applied to the catalyst. Higher temperatures, up to 350° C., are also suitable provided the residence time of the catalyst in the drier is less than 5 minutes.

EXAMPLE 2

A bleach composition was formulated comprising:

| Component | Weight (grams) |
|---|---|
| Sodium carbonate | 1.00 |
| Sodium tripolyphosphate | 0.31 |
| Sodium perborate monohydrate | 0.31 |
| Manganese/zeolite bleach activator | — |

Bleaching tests were conducted with a four pot Tergotometer apparatus from the U.S. Testing Company. Wash solutions were prepared from deionized water of 12° French hardness (Ca/Mg 2:1). Solutions were raised to pH of about 10.9 by addition of 4 ml of 1N sodium hydroxide. Wash volumes were 1 liter. Temperature was maintained at 100° F. Agitation was provided throughout a 20 minute wash period.

Bleach activity was determined by measuring the change in reflectance (αR) of a dry cotton cloth (4"×6"). Prior to bleaching, the cloth was uniformly stained with a tea solution and washed several times in a commercial detergent. Reflectance was measured on a Gardner XL-23 reflectometer.

Varying amounts of bleach catalyst were added to the aforementioned bleach composition. Catalysts were prepared according to Example 1, except that manganese chloride amounts were altered to provide a range of metal concentration as outlined in Table I. The control catalyst was also prepared in the manner outlined in Example 1 except that the zeolite was not treated with magnesium chloride. Higher reflectance changes signify greater bleach effectiveness.

Table I outlines the performance of various total catalyst levels and differing amounts of manganese adsorbed thereon. For instance, 0.2% Mn represents a zeolite treated with 0.2% manganese chloride.

TABLE I

| Set A (Control) | ΔR | | | |
|---|---|---|---|---|
| Weight of | Manganese Catalyst Absent Magnesium Treatment | | | |
| Catalyst (gram) | .2% Mn | .4% Mn | .6% Mn | .9% Mn |
| 0.0 | 4.3 | 3.8 | 4.8 | 3.7 |
| 0.08 | 4.8 | 3.9 | 4.2 | 7.2 |
| 0.13 | 4.9 | 5.5 | 5.6 | 8.8 |
| 0.16 | 4.7 | 5.3 | 8.5 | 8.2 |
| 0.22 | 5.8 | 6.1 | 7.9 | 9.5 |
| 0.30 | 6.0 | 7.6 | 8.6 | 9.6 |

| Set B | ΔR | | |
|---|---|---|---|
| Weight of | Manganese Catalyst With Magnesium Treatment | | |
| Catalyst (gram) | .2% Mn | .4% Mn | .9% Mn |
| 0.0 | 4.4 | 3.7 | 3.6 |
| 0.08 | 6.8 | 10.4 | 9.3 |
| 0.13 | 7.4 | 10.9 | 12.6 |
| 0.16 | 7.7 | 10.2 | 14.6 |
| 0.22 | 10.0 | 11.9 | 13.8 |
| 0.30 | 9.8 | 14.6 | 14.5 |

Table I demonstrates that when manganese is adsorbed onto zeolite, the resulting solid can accelerate the bleaching from peroxide solutions. Furthermore, the mixed metal catalyst under Set B, Table I, is shown to provide substantially better bleaching than non-treated Set A. In Set B, the zeolite has been treated with both magnesium and manganese. The mixed metal catalyst has a greater αR than non-treated manganese on zeolite at each level of catalyst weight investigated.

EXAMPLE 3

Herein illustrated are the effects of divalent metal cations other than magnesium on the bleach activity of a manganese impregnated zeolite. Catalysts were prepared according to Example 1, except for substitution of magnesium with the hereinbelow stated divalent metals and corresponding changes in their employed weights. The alternate salts evaluated were zinc chloride, calcium chloride, copper sulphate and iron nitrate.

Catalysts were incorporated into a bleach composition with the following formulation:

| Component | Weight (grams) |
|---|---|
| Sodium carbonate | 0.5 |
| Sodium tripolyphosphate | 0.1 |
| Sodium perborate monohydrate | 0.3 |
| Nonionic surfactant | 0.15 |
| Manganese/Zeolite bleach activator | — |

Bleaching tests were conducted as described in Example 2. Results for these tests are outlined in Table II.

TABLE II

| Mixed Metal Catalyst Bleach Performance | | | | |
|---|---|---|---|---|
| | ΔR | | | |
| Weight of Catalyst (grams) | Control* 0.5% Mn only | 2% $ZnCl_2$ | 2% $CaCl_2$ | 2% $MgCl_2$ |
| 0.0 | 0.69 | 2.32 | 1.01 | 0.50 |
| 0.05 | 2.80 | 3.10 | 1.36 | 2.90 |
| 0.10 | 3.64 | 4.60 | 2.79 | 4.21 |
| 0.15 | 4.31 | 4.07 | 3.06 | 4.6 |
| 0.20 | 4.48 | 5.50 | 3.72 | 5.50 |
| 0.25 | 4.40 | 5.09 | 4.65 | 6.03 |

*0.5% (manganese on zeolite) with other columns indicating additional amounts and type of second metal salt impregnated alongside manganese ions.

The results listed in Tables I and II demonstrate that the presence of zinc or magnesium salt along with manganese on the zeolite catalyst improves bleaching relative to that of a purely manganese impregnated substrate. Calcium, copper and iron salts when combined with manganese on the catalyst retard the bleach performance relative to the control material.

The foregoing description and examples illustrate selected embodiments of the present invention and in light thereof variations and modifications will be suggested to one skilled in the art, all of which are in the spirit and purview of this invention.

What is claimed is:

1. A bleaching composition comprising:

(a) a peroxy compound; and (b) a bleach catalyst comprising an aluminosilicate support material whereon is adsorbed a water-soluble manganese (II) salt and a salt of a divalent metal cation selected from magnesium or zinc;

the weight ratio of manganese (II) to divalent metal cation being from about 1:20 to 20:1, the ratio of divalent metal cation to aluminosilicate support material ranging from about 1:1000 to 1:10, and the weight ratio of catalyst to peroxy compound being from about 1:100 to 1:1.

2. A bleaching composition according to claim 1 wherein the aluminosilicate support material is a zeolite.

3. A bleaching composition according to claim 1 wherein the aluminosilicate support material has a pore size from about 3 to 10 Angstroms.

4. A bleaching composition according to claim 1 wherein the aluminosilicate support material is silicoalumino phosphate.

5. A bleaching composition according to claim 1 wherein the peroxy compound is sodium perborate.

6. A bleaching composition according to claim 1 further comprising an inorganic phosphate salt stabilizer in an amount from about 5 to 35% by weight of the total composition.

7. A bleaching composition according to claim 6 wherein the phosphate stabilizer is chosen from the group consisting of tripolyphosphate, orthophosphate, pyrophosphate and mixtures thereof.

8. A bleaching composition according to claim 1 further comprising from 1 to 98% of laundry detergent adjuncts selected from the group consisting of surfactants, builders, fabric softeners, enzymes, inorganic fillers, colorants, lather boosters and mixtures thereof.

9. A process for preparation of a catalyst for the controlled decomposition of peroxy compounds comprising:

(a) dissolving a water-soluble salt of manganese (II) and of a divalent metal cation selected from magnesium or zinc, in a solvent and therein suspending an aluminosilicate support material to form a slurry, the weight ratio of divalent metal cation to the aluminosilicate ranging from 1:1000 to 1:10 and of manganese (II) to divalent metal cation ranging from about 1:20 to 20:1;

(b) adjusting pH to achieve a value from about 7.0 to 11.1;

(c) agitating the slurry mixture of divalent metal salt and aluminosilicate support material;

(d) separating solids from the slurry and washing said solid composition with solvent to remove any traces of free manganese (II) salts; and (e) drying the solid composition to remove solvent and moisture.

10. A process according to claim 9 wherein the aluminosilicate support material is a zeolite.

11. A process according to claim 9 wherein the aluminosilicate support material has a pore size from about 3 to 10 Angstroms.

12. A process according to claim 9 wherein the aluminosilicate support material is silicoalumino phosphate.

13. A process according to claim 9 wherein the peroxy compound is sodium perborate.

14. A process according to claim 9 further comprising an inorganic phosphate salt stabiizer in an amount from about 5 to 35% by weight of the total composition.

15. A process according to claim 14 wherein the phosphate stabilizer is chosen from the group consisting of tripolyphosphate, orthophosphate, pyrophosphate and mixtures thereof.

16. A process according to claim 9 wherein the solvent is water.

17. A method for bleaching a substrate comprising placing the substrate into water and treating with a composition comprising:

(a) a peroxy compound present in an amount to deliver at least 30 mg active oxygen per liter to the wash solution; and (b) a bleaching catalyst which delivers at least 0.5 ppm manganese (II) cation per liter was solution, said catalyst comprising an aluminosilicate support material whereon is adsorbed a water-soluble manganese (II) salt and a salt of a divalent metal cation selected from magnesium or zinc;

the weight ratio of manganese (II) to divalent metal cation being from about 1:20 to 20:1, the ratio of divalent metal cation to aluminosilicate support material being from about 1:1000 to 1:10.

18. A method according to claim 17 further comprising an inorganic phosphate salt stabilizer present in an amount to deliver from about 0.05 to 0.30 grams per liter wash solution.

19. A method according to claim 18 wherein the phosphate salt is selected from the group consisting of tripolyphosphate, orthophosphate, pyrophosphate and mixtures thereof.

20. A method according to claim 17 wherein the peroxy compound is a sodium perborate salt.

21. A method according to claim 17 wherein the composition further comprises from 1 to 98% of laundry detergent adjuncts selected from the group consisting of surfactants, builders, fabric softeners, enzymes, inorganic fillers, colorants, lather boosters and mixtures thereof.

* * * * *